United States Patent [19]

Rutten

[11] Patent Number: 4,497,565

[45] Date of Patent: Feb. 5, 1985

[54] EXPOSURE DEVICE FOR LOCALLY DISCHARGING A PHOTOCONDUCTIVE IMAGING ELEMENT

[75] Inventor: Hendrik G. J. Rutten, Arcen, Netherlands

[73] Assignee: Océ-Nederland B.V., Venlo, Netherlands

[21] Appl. No.: 419,215

[22] Filed: Sep. 16, 1982

[30] Foreign Application Priority Data

Sep. 30, 1981 [NL] Netherlands ..... 8104461

[51] Int. Cl.[3] ..... G03G 15/04

[52] U.S. Cl. ..... 355/3 R; 355/71; 362/277; 362/311; 362/319

[58] Field of Search ..... 355/3 R, 3 ER, 71; 362/35, 257, 277, 280, 282, 291, 306, 311, 319, 321, 324

[56] References Cited

U.S. PATENT DOCUMENTS

| | | | |
|---|---|---|---|
| 1,333,033 | 3/1920 | Narodick | 362/291 |
| 1,864,418 | 6/1932 | Ehlers | 362/257 |
| 2,233,280 | 2/1941 | Barnes | 362/319 |
| 4,074,124 | 2/1978 | Maute et al. | 362/280 X |
| 4,129,378 | 12/1978 | Rattin et al. . | |
| 4,425,599 | 1/1984 | Rieder et al. | 362/319 X |

*Primary Examiner*—Fred L. Braun

*Attorney, Agent, or Firm*—Albert C. Johnston

[57] ABSTRACT

An exposure device for homogeneously exposing to light and thus discharging regions of a photoconductive imaging element located outside the regions thereof on which images are to be formed makes use of a lamp housing having a window for passing light to the element and masking member having a terminal edge extending obliquely relative to an axis of the window, and displaceable laterally relative thereto, for covering any desired portion of the area of the window. The masking member can be a tubular member surrounding and turnable about the housing and having a helical edge that can be disposed at any desired location over the window by turning the tubular member. The exposure device can be mounted over a moving photoconductive element such as a photoconductive belt or drum in oblique relation to the direction of movement of the element so that the terminal edge of the masking member will always be parallel to that direction.

8 Claims, 2 Drawing Figures

EXPOSURE DEVICE FOR LOCALLY DISCHARGING A PHOTOCONDUCTIVE IMAGING ELEMENT

This invention relates to an exposure device for homogeneously exposing to light and thus discharging regions of a photoconductive imaging element located outside the regions thereof on which images are to be formed.

A device for the stated purpose is disclosed in UK Patent Specification No. 1 422 175. In that known device, a light source in the form of an electroluminescent panel is seated in a holder which positions the panel close to the surface of a photoconductive element on a rotatable drum. The holder and the electroluminescent panel are enclosed in a masking or shade member that is slidable to and fro along them to a desired adjusted position in order to subject only a desired portion of the width of the photoconductive element, typically a marginal region thereof lying outside the imaging region, to discharging radiation from the panel.

A device of that known construction generally requires considerable space to be kept available for sliding movement of the shade member away from the regions of the photoconductive element that are to be exposable to light from the luminescent panel. Such a space requirement is disadvantageous in a photocopying machine. Another disadvantage of that known device is that a relatively complex mechanism is required for connecting the shade member with a driving source so that minute adjustments of the position of the shade member can be effected accurately.

The principal object of the present invention is to provide an exposure device for the stated purpose which does not involve the disadvantages noted above, and which, although of simple construction, enables very accurate adjustment of the boundary between an imaging region of a photoconductive element and a region thereof that is to be discharged by radiation from a light source.

According to the present invention, an exposure device for the stated purpose comprises a housing containing a light source and having along a side of the housing a light-transmitting plane, or window, through which light from the light source may be passed to a region of a photoconductive element located opposite the window, and the device comprises a masking member which has a terminal edge extending obliquely relative to the longitudinal axis of the window and which is displaceable transversely relative to that axis so that the window can be covered and the light transmission blocked off to desired extent by transverse displacement of the masking member. The masking member advantageously comprises a tubular body which is rotatable about the housing and is formed with a helical terminal edge that can extend over the light-transmitting plane or window.

Thus, in an electrostatic photocopying machine making use of the invention, the exposure device can be mounted obliquely relative to the direction of movement of the photoconductive imaging element so that the helical terminal edge of the masking member lies parallel to that direction, and by simple rotation of the masking member the terminal edge can be brought to any of various desired positions along the window, in which the light-transmitting plane is covered so as to establish a desired line of demarcation between the imaging region of the photoconductive element and a marginal region thereof that is to be exposed homogeneously to discharging light.

The above mentioned and other objects, features and advantages of the invention will be further evident from the following description and the accompanying drawings of an illustrative embodiment thereof. In the drawings.

Figure 1:
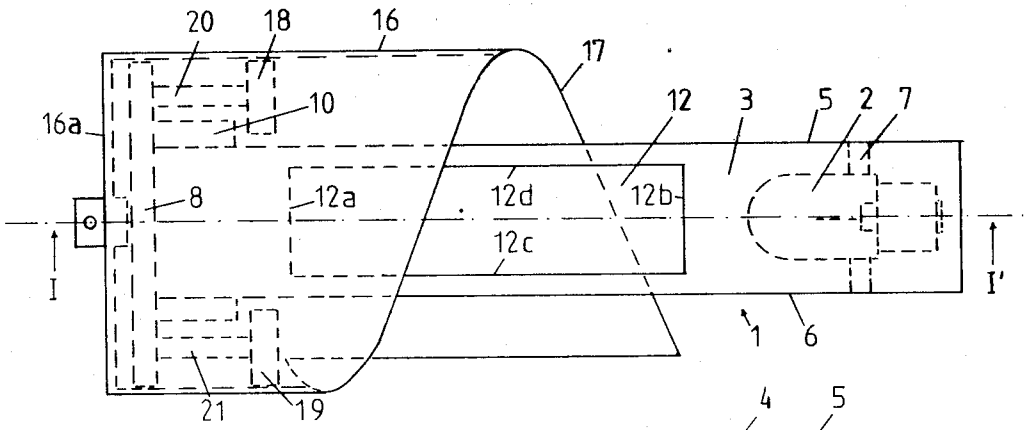
FIG. 1 is a schematic plan view of an exposure device embodying the invention.
Figure 2:
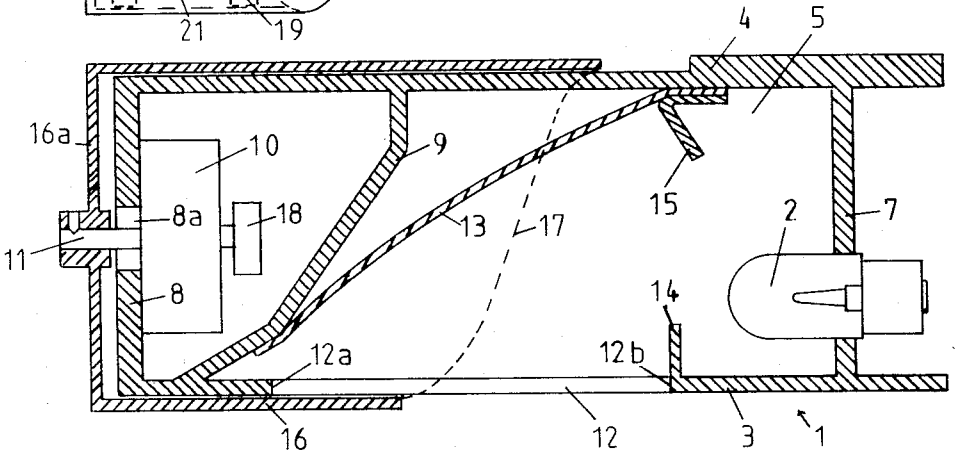
FIG. 2 is a cross-section through the same exposure device, taken along the line I—I' in FIG. 1.

The exposure device as illustrated in FIGS. 1 and 2 comprises an elongate rectangular housing 1 formed by four elongate side walls 3,4,5 and 6 and two end walls 7 and 8. The housing 1 contains a partition 9 dividing the housing into two compartments. One of the compartments contains a light source 2 and a reflector 13 and is bounded by the elongate walls 3,4,5 and 6, end wall 7 and partition 9. The other compartment contains a motor 10 and is bounded by parts of the side walls 3 and 4, end wall 8 and partition 9. The side walls 5 and 6 extend only over the reflector compartment, leaving the motor compartment open at opposite sides thereof.

The motor 10 preferably is a stepping motor, and is mounted in the motor compartment against end wall 8 with a shaft 11 of the motor extending out through an opening 8*a* in that wall. The light source 2, for instance an incandescent lamp, is mounted in end wall 7 of the reflector compartment.

Side wall 3 of the housing 1 is formed with an elongated rectangular opening, or window, 12 having two short ends 12*a* and 12*b* and two long sides 12*c* and 12*d*. The reflector 13 is a panel having a reflecting surface, which bridges the space between the side walls 5 and 6 and extends from an end portion fixed to side wall 4 at a location above the lamp 2 to an opposite end portion fixed to the partition 9 at a location near side wall 3 and the short end 12*a* of the window 12. Blackpainted screens 14 and 15 project from the walls 3 and 4 respectively at locations near the light source 2 to prevent light from passing directly from the lamp through the opening 12, thus allowing the window opening to transmit only lamp light that is reflected by the reflecting panel 13.

A tubular, opaque masking member 16 extends over the motor compartment of the housing 1 and is closed at one end by an end wall 16*a* fixed to the shaft 11 of the stepping motor 10. The masking member has a cylindrical body which at its other end is open and terminates in an edge 17 having the form of a one-turn helix.

Two guide rollers 18 and 19 bear against the inner side of the cylindrical body and thus support the masking member for rotation about the housing 1. These rollers are secured rotatably to shafts 20 and 21, respectively, which in turn are fixed to portions of the end wall 8 that project laterally beyond the housing 1.

One end of the helical edge 17 of the masking member can extend substantially to the end 12*a*, and the other end thereof can extend substantially to the end 12*b*, of the elongate window 12. When the shaft 11 of the stepping motor is rotated through a specific angle the masking member is rotated through the same angle about the housing 1, so that the window 12 will then be covered by the masking member to an extent dependent on the angle of rotation of the motor. Thus, the helical terminal edge 17, which extends obliquely relative to the longitudinal axis of the window 12, can easily be displaced transversely relative to the window so as to establish along it any desired degree of masking of the light transmitting plane at the window.

The exposure device herein described can be mounted near to and above the photoconductive surface of an imaging belt or drum in a copying machine with the axis of the masking member lying oblique to the direction of movement of the belt or drum so that, in all positions of adjustment of the masking member, the portion of the helical edge 17 which extends over the window opening 12 will lie parallel to the direction of movement of the belt or drum. It results that a marginal strip of any desired width along an edge of the photoconductive belt or drum can be exposed to discharging light from the window 12 by simply turning the masking member 16 to an appropriate angular position relative to the window. The exposure serves, for example, to discharge a marginal region of the photoconductive belt or drum that lies outside the region thereof in which an imaging charge pattern is present or is to be formed on the belt or drum.

The angle of rotation of the masking member 16 by the stepping motor 10 can be controlled by control means which calculate the width of the region required to be homogeneously exposed and automatically adjust the terminal edge 17 to that width by reference to control data related to the size of the original to be copied, the size scale of reproduction of the original and the size of the copy paper. The angle of rotation can be controlled in such a way that the width of the region to be discharged is always adjusted to the smaller of two dimensions, i.e. either to the dimension of the projected image or to that of the copy paper.

It will be evident to persons skilled in the art that the invention herein disclosed is not restricted to the particular embodiment described above. For example, the accuracy of adjustment of the position of the terminal edge 17 can be enhanced by providing a gearbox between the motor and the masking member in order to retard the adjusting rotation. Nor is it necessary for the helical edge to follow a helical line of one revolution; a half-turn helix or some other forms of the displaceable edge lying oblique to the window axis can also be used.

I claim:

1. An exposure device for homogeneously exposing to light regions of a photoconductive imaging element located outside regions thereof on which images are to be formed, comprising a housing containing a light source and having a window through which light may be passed to a said element and masking means for covering any desired portion of the area of said window, said masking means comprising an opaque member for overlying a portion of said window and having a terminal edge extending obliquely relative to an axis of said window, said opaque member being displaceable transversely relative to said window axis to vary the location of said terminal edge over said window and thus adjust the extent of masking of said area.

2. An exposure device according to claim 1, said opaque member being a tubular member turnable relative to said housing about a central axis substantially parallel to said window axis, said terminal edge being a helical edge on an end of said tubular member and extending helically about said central axis so as to be positionable at any desired location over said window by turning movement of said member relative to said housing.

3. An exposure device according to claim 2, said housing comprising a reflector compartment and a motor compartment, said reflector compartment containing said light source and containing a reflective panel arranged opposite said window so as to reflect light from said source through said window, said motor compartment containing a motor connected with said tubular member for turning said member.

4. An exposure device according to claim 3, said motor being a stepping motor having its shaft joined to a wall of said tubular member at the other end thereof, said motor compartment containing roller means rotatably supporting the body of said tubular member.

5. An exposure device according to claim 2, said tubular member surrounding and being turnable about an end portion of said housing.

6. An exposure device for homogeneously exposing to light regions of a photoconductive imaging element located outside regions thereof on which images are to be formed, comprising a housing containing a light source and having a window through which light may be passed to a said element and masking means for covering a desired portion of the area of said window, said masking means comprising an opaque member having a terminal edge extending obliquely relative to an axis of said window and being displaceable transversely relative thereto to adjust the extent of masking of said area;

said opaque member being a tubular member enveloping and turnable about said housing and having at one of its ends a helical edge positionable at a desired location over said window by turning movement of said member about said housing;

said housing comprising a reflector compartment and a motor compartment, said reflector compartment containing said light source and containing a reflective panel arranged opposite said window so as to reflect light from said source through said window, said motor compartment containing a motor connected with said tubular member for turning said member about said housing.

7. An exposure device according to claim 6, said motor being a stepping motor having its shaft joined to a wall of said tubular member at the other end thereof, said motor compartment containing roller means rotatably supporting the body of said tubular member.

8. An exposure device according to claim 1, 2, 3, 4, 5, 6, or 7, said device being mountable over a marginal region of the path of a photoconductive imaging element with said window axis disposed oblique to the direction of movement of the imaging element so that said terminal edge will be parallel to said direction of movement in all masking positions of said opaque member.

* * * * *